US006556118B1

(12) United States Patent
Skinner

(10) Patent No.: US 6,556,118 B1
(45) Date of Patent: Apr. 29, 2003

(54) SEPARATE MOUNT IGNITION COIL UTILIZING A PROGRESSIVE WOUND SECONDARY WINDING

(75) Inventor: Albert Anthony Skinner, Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/518,577

(22) Filed: Mar. 3, 2000

(51) Int. Cl.[7] ..... H01F 27/28

(52) U.S. Cl. ..... 336/182; 336/175; 336/96; 123/634

(58) Field of Search ..... 336/175, 176, 336/96, 84 R, 107, 182; 123/634, 635

(56) References Cited

U.S. PATENT DOCUMENTS

| | | | | |
|---|---|---|---|---|
| 3,886,434 A | * | 5/1975 | Schreiner | 321/27 R |
| 4,794,361 A | | 12/1988 | Young | 336/189 |
| 5,015,982 A | | 5/1991 | Skinner et al. | 336/69 |
| 5,444,427 A | * | 8/1995 | Ida et al. | 336/198 |
| 5,706,792 A | | 1/1998 | Boyer et al. | 123/634 |
| 5,767,758 A | * | 6/1998 | Sakamaki | 336/84 M |
| 5,929,736 A | | 7/1999 | Sakamaki et al. | 336/96 |
| 6,216,679 B1 | * | 4/2001 | Skinner et al. | 123/635 |

* cited by examiner

*Primary Examiner*—Elvin Enad
*Assistant Examiner*—Kyung Lee
(74) *Attorney, Agent, or Firm*—Margaret A. Dobrowitsky

(57) ABSTRACT

An ignition coil assembly includes a core formed of magnetically-permeable material extending along a main axis, a primary winding disposed about the core, a secondary winding disposed on a secondary winding spool wherein at least one of the secondary winding leads is connected to a high-voltage connector terminal portion of the ignition coil assembly configured for connection to a remotely disposed spark plug, a case formed of electrical insulating material, and a magnetically-permeable shield disposed outwardly of the case. The secondary winding is progressively wound on the secondary winding spool, thereby eliminating failure modes associated with the segment-wound secondary windings, and, eliminating the need for pole pieces in the magnetic circuit, thereby reducing components, cost, weight, and size of the ignition coil assembly.

3 Claims, 4 Drawing Sheets

16
12
$18_{3-6}$
IGNITION SYSTEM
10
20
18
$18_{2-5}$
$18_{1-4}$
74
66
$80_2$
84
72
22
72
84
68
72
72
84
15
14
$78_1$
$80_1$
$78_6$
$78_2$
$78_4$
96
24
96
96
96
96

SEPARATE MOUNT IGNITION COIL UTILIZING A PROGRESSIVE WOUND SECONDARY WINDING

BACKGROUND OF THE INVENTION

1. Field of the Invention

The present invention relates generally to ignition coils for developing a spark firing voltage that is applied to one or more remotely mounted spark plugs of an internal combustion engine.

2. Description of the Related Art

An ignition coil configured to be mounted in an automotive engine compartment remotely from a spark plug is known that includes a so-called "segment" wound secondary winding, as seen by reference to U.S. Pat. No. 5,015,982 issued to Skinner et al. Skinner et al. disclose an ignition coil configured for operation in a waste spark system having a magnetically-permeable core, a primary winding, and a secondary winding disposed on a secondary winding spool. The first and second ends of the secondary winding are connected to respective high-voltage towers for connection to remotely installed spark plugs. The secondary winding spool disclosed in Skinner et al. further includes a plurality of axially spaced and circumferentially extending ribs, which, in combination with the outside diameter (O.D.) of the spool body, define a plurality of axially spaced winding slots. Skinner et al. disclose that each of the winding slots contain a coil winding.

Remote or separately mounted ignition coils conventionally employ a segmented secondary winding such as disclosed in Skinner et al. However, there are drawbacks to the segmented secondary winding configuration. First, a so-called crossover region of the secondary winding spool (i.e., a region to allow the secondary winding to transition between winding slots) is relatively difficult to fill with conventionally employed dielectric materials, such as epoxy potting material. This difficulty is worsened when polyester material is used. The foregoing described failure to fill certain areas with epoxy potting material leads to certain failure modes due to the lack of the needed electrical insulation in the secondary circuit.

Another drawback with segmented wound secondary windings involves the crossover region itself, where certain stresses on the winding increase the likelihood of failure. A third drawback is that the axially spaced ribs increase the size the ignition coil itself. In particular, since the ribs of the spool extend radially outwardly relative to the centrally disposed core, the radial size of the coil is also increased. Notably, a magnetically-permeable shield, which is conventionally included to provide, among other things, a flux return path, is conventionally also radially moved outwards a corresponding distance. This increased outward spacing of the shield leads to a requirement of including so-called "pole pieces" at opposing axial ends of the core in the ignition coil so as to bridge the now increased core-to-shield radial distance (i.e., to complete the magnetic circuit). For example, Skinner et al. referred to above disclose such pole pieces. The pole pieces, however, increase the cost, size and weight of the ignition coil.

It is also known, however, to provide a so-called "pencil" ignition coil (i.e., a relatively slender ignition coil configured to be mounted directly above and to a spark plug) having a secondary winding wound on a spool in accordance with a so-called "progressive" winding approach, as seen by reference to U.S. Pat. No. 5,929,736 issued to Sakamaki et al. Sakamaki et al. disclose an ignition coil configured to be mounted directly to a spark plug but which has a secondary winding that is wound in accordance with a progressive winding technique. The secondary winding spool disclosed in Sakamaki et al. therefore does not have the axially spaced ribs defining winding slots described above. However, it is not always possible or desirable to mount an ignition coil directly to the spark plug. Therefore, in many instances, the coil must be mounted remotely, and therefore the teachings of Sakamaki et al. cannot be followed.

There is therefore a need to provide an improved ignition coil that minimizes or eliminates one or more of the shortcomings as set forth above.

SUMMARY OF THE INVENTION

An ignition coil assembly in accordance with the present invention is characterized by the features specified in claim 1.

An ignition coil assembly in accordance with the present invention includes a progressive wound secondary winding that results in a smaller package than a comparable segment wound ignition coil assembly. The invention further eliminates failure modes associated with ignition coils of the type having a segment wound secondary winding. Moreover, due to significant reductions in size, certain components conventionally found on remotely-mounted ignition coils, such as so-called "pole pieces" can be eliminated, thus providing an ignition coil assembly that has fewer components, uses fewer materials, provides a simplified core structure, all at a lower cost, smaller size, and having a reduced weight compared to conventional designs.

These and other advantages are realized by an ignition coil assembly in accordance with the present invention, which includes a core formed of magnetically-permeable material extending along a main axis, a primary winding disposed about the core, a secondary winding disposed on a secondary winding spool also disposed about the core wherein at least one of first and second ends of the secondary winding is electrically connected to a high-voltage connector terminal configured for connection to a remotely disposed spark plug, a case formed of electrical insulating material, and a magnetically-permeable shield disposed outwardly of the case, characterized in that: the secondary winding is progressively wound on the secondary winding spool.

BRIEF DESCRIPTION OF THE DRAWINGS

The present invention will now be described by way of example, with reference to the accompanying drawings, in which.

DETAILED DESCRIPTION OF THE PREFFERED EMBODIMENT

Figure 1:
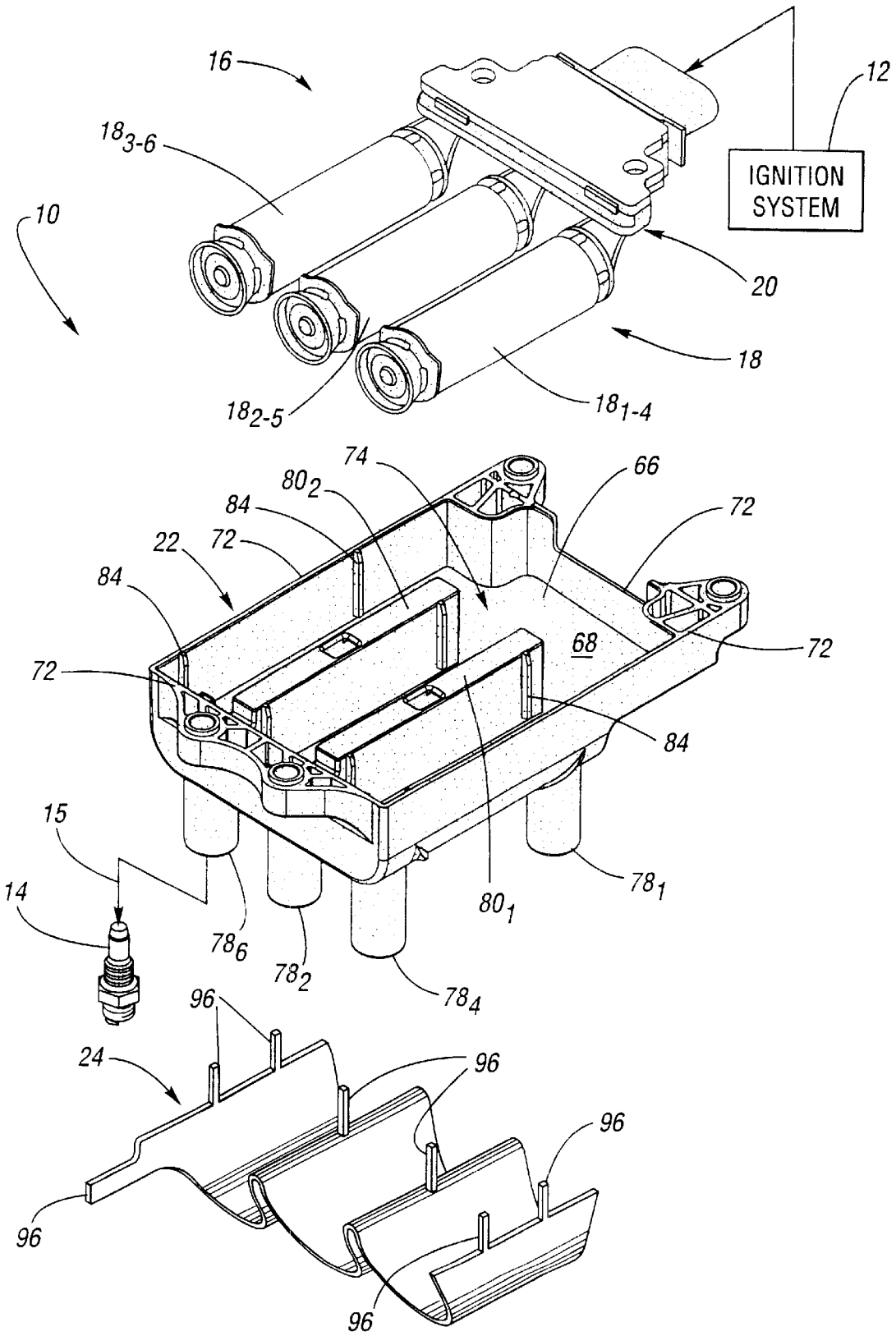
FIG. 1 is a simplified, exploded perspective view of an ignition coil assembly in accordance with the present invention.

Referring now to the drawings wherein like reference numerals are used to identify identical components in the various views, FIG. 1 is an exploded, perspective view of an ignition coil assembly 10 in accordance with the present invention. As is generally known, ignition coil assembly 10 may be coupled to, for example, an ignition system 12, which contains primary energization circuitry for controlling the charging and discharging of ignition coil assembly 10. Further, also as is well known, the relatively high-voltage produced by ignition coil assembly 10 is provided to a conventional spark plug 14 remotely mounted from ignition coil assembly 10 by way of a conventional ignition cable 15. Spark plug 14 may be retained by a threaded engagement with a spark plug opening in a combustion chamber of the engine (as conventional). The resulting spark event may be employed to initiate combustion in a combustion chamber of an internal combustion engine. Such an engine (not shown) may be used to power, for example, an automotive vehicle. Ignition system 12, spark plug 14, and ignition cable 15 perform conventional functions well known to those of ordinary skill in the art.

The ignition coil assembly 10 shown in FIG. 1 is adapted for use with a six-cylinder engine and is further configured for operation in a so-called distributorless ignition system (DIS) where a given secondary winding is connected to two spark plugs (i.e., a so-called waste spark system).

Ignition coil assembly 10 is adapted for installation in an engine compartment of an automotive vehicle, preferably, to an engine (or portion thereof) directly or to a side wall or the like of the engine compartment. In any event, ignition coil assembly 10 is remotely mounted from the spark plug 14, thereby requiring an electrical connection, such as an ignition cable 15, to obtain proper operation.

The configuration for an ignition coil assembly to be described in detail hereinafter reduces size, cost, and weight by utilizing a progressive wound secondary winding in lieu of a segment-wound secondary winding. Other advantages, such as elimination of failure modes associated with the segment-wound secondary winding, are also realized, as will be described.

A detailed description of a preferred embodiment will now be set forth. With a continued reference to FIG. 1, in accordance with the present invention, ignition coil assembly 10 includes a coil and module assembly 16 (comprising a coil assembly 18 and a module assembly 20), a case assembly 22, a shield 24, and one or more coil covers designated $\mathbf{26}_1$, $\mathbf{26}_2$, and $\mathbf{26}_3$ in the drawings (best shown in FIG. 3).

Coil assemblies $\mathbf{18}_{1\text{-}4}$, $\mathbf{18}_{2\text{-}5}$, and $\mathbf{18}_{3\text{-}6}$ are each configured generally for transforming a relatively low voltage (e.g., 12 volts obtained from a conventional vehicle battery) to a relatively high voltage sufficient to produce a spark across the gap of the spark plug. Inasmuch as the illustrated embodiment is configured for use in a waste spark system, each coil assembly 18 fires two spark plugs disposed in respective cylinders of the engine. For example, the coil assembly designated $\mathbf{18}_{1\text{-}4}$ provides a spark firing voltage to spark plugs disposed in engine cylinder Nos. 1 and 4. This result is achieved by connecting first and second ends of the secondary winding to respective high voltage towers for each cylinder, which are then connected to the plugs for cylinder Nos. 1 and 4 via multiple cables 15. Ignition coil assembly 10 further includes coil assembly $\mathbf{18}_{2\text{-}5}$ for cylinder Nos. 2 and 5, and coil assembly $\mathbf{18}_{3\text{-}6}$ for cylinder Nos. 3 and 6.

Figure 6:
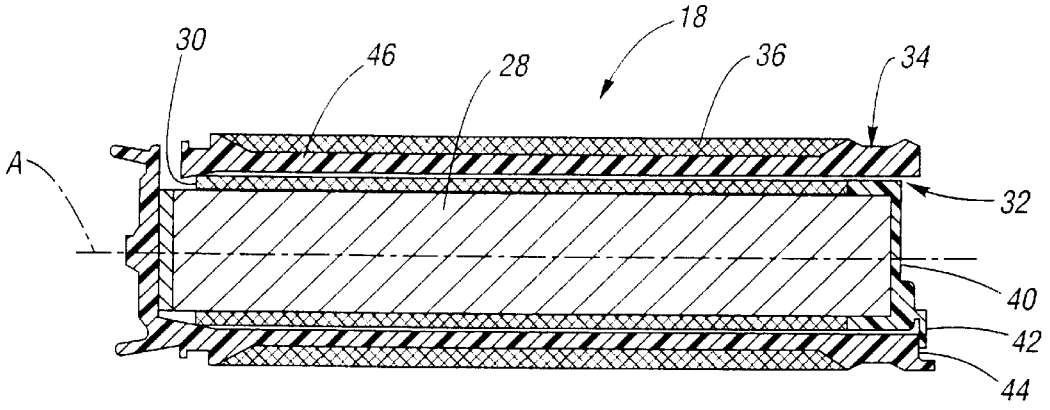
FIG. 6 is a simplified, cross-section view of a coil assembly portion of the ignition coil assembly shown in FIG. 1.

FIG. 6 shows a partial detail of coil assembly 18, each coil assembly $\mathbf{18}_i$ (where i=1–4, 2–5, or 3–6) includes a primary winding assembly comprising a core 28 and a primary winding 30, dielectric material, such as epoxy potting material 32, a secondary winding spool 34, and a secondary winding 36 that is progressively wound on secondary winding spool 34.

Figure 4:
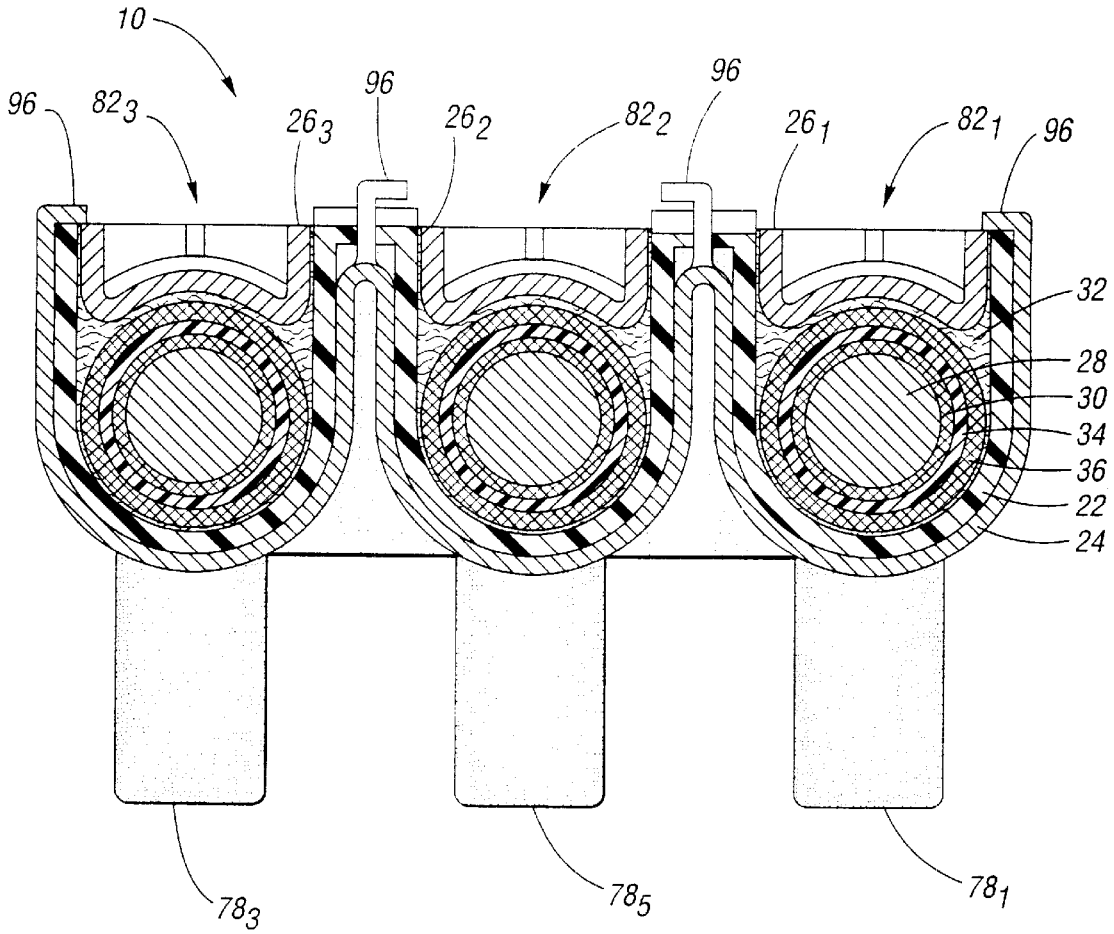
FIG. 4 is a simplified, cross-section view of the ignition coil assembly shown in FIG. 3 taken substantially along lines 4—4.

Core 28 may be elongated, having a main, longitudinal axis associated therewith designated axis "A" in the Figure. Core 28 includes an upper, first end and a lower, second end. Core 28 comprises magnetically-permeable material, such as a plurality of silicon steel laminations, or, alternatively, plastic coated iron particles formed in a compression molding operation, as known in the art, for example, as disclosed in U.S. Pat. No. 5,015,982 entitled "IGNITION COIL", hereby incorporated by reference in its entirety. As illustrated, core 28 may assume a generally cylindrical shape (which is a generally circular shape in radial cross-section, as shown in FIG. 4).

Primary winding 30 may be wound directly onto core 28; however, in a constructed embodiment, primary winding 30 is wound on a primary winding spool (not shown) of conventional construction. Primary winding 30 includes first and second ends and is configured to carry a primary current $I_p$ for charging the respective coil assembly (i.e., one of $\mathbf{18}_{1\text{-}4}$, $\mathbf{18}_{2\text{-}5}$, or $\mathbf{18}_{3\text{-}6}$) upon control of ignition system 12. Winding 30 may be implemented using known approaches and conventional materials. For example, in one embodiment, primary winding 30 comprised 166 turns (166T) of #20 AWG, single build polyester coated wire, in two layers, for a nominal 10A peak primary current $I_p$. It should be understood that the foregoing is merely exemplary rather than limiting in nature. One of ordinary skill in the art will realize alternative configurations based on particular design criteria.

Figure 5:
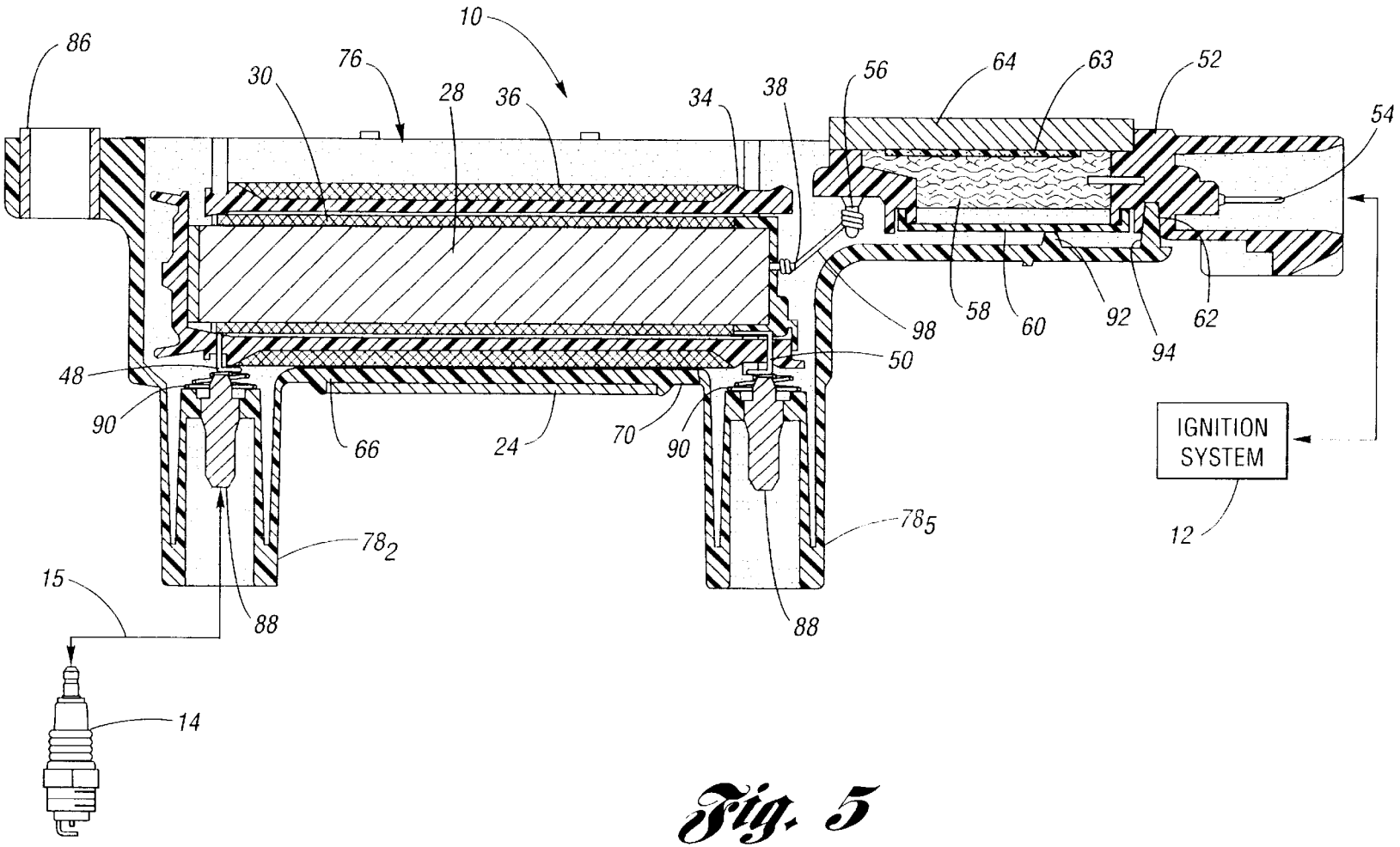
FIG. 5 is a simplified, cross-section view of the ignition coil assembly shown in FIG. 3 taken substantially along lines 5—5.

With reference to FIG. 5, the primary winding assembly further includes a pair of posts formed of non-conductive material such as plastic (e.g., the spool material), upon which the first and second ends of primary winding 30 are temporarily wound. One such post, designated post 38, is shown in FIG. 5. Thus, for the three primary coil assemblies there are six (6) posts like post 38.

The posts project outwardly, either radially or axially, from the respective coil assembly $\mathbf{18}_i$ to provide a post or the like to enable subsequent connections to corresponding metal terminals of module assembly 20. In particular, after the primary winding has been wound on the spool, the ends are wound on posts 38 until later. Then, during final assembly, the ends are unwound from post 38, extended to and wound directly to module 20.

FIG. 6 shows that the primary winding assembly also includes a cap portion 40 disposed on the upper end of core 28 and which may be a portion of the primary winding spool (not shown). Cap portion 40 includes a mechanical stop feature 42, which extends radially outwardly over a preselected circumferential range.

An annular spacing defining a potting "channel" is established between the outside diameter (O.D.) of primary winding 30, and an inside diameter (I.D.) of secondary winding spool 34. This "channel" is filled with potting material 32 during assembly. The potting material 32 performs the function of electrical insulation and, provides protection from environmental factors, which may be encountered during the service life of ignition coil assembly 10. There are a number of suitable epoxy potting materials well known to those of ordinary skill in the art.

Secondary winding spool 34 is configured to receive and retain secondary winding 36. Spool 34 is disposed adjacent to and radially outwardly of the central components comprising core 28 and primary winding 30 (in addition to epoxy potting material 32). Preferably, spool 34 is in coaxial relationship with core 28, and primary winding 30.

Spool 34 is formed generally of electrical insulating material having properties suitable for use in a relatively high temperature environment. For example, spool 34 may comprise plastic material such as polybutylene terephthalate (PBT) thermoplastic polyester.

Secondary winding spool 34 includes a land or shoulder 44 disposed on an upper axial end thereof extending from a generally cylindrical spool body 46 having a smooth outer surface.

Referring to FIG. 5, secondary winding spool 34 also includes a first high-voltage terminal 48, and a second high-voltage terminal 50, preferably insert molded in the spool body. Terminals 48 and 50 comprise electrically conductive material, such as metal. These HV terminals 48, 50 are configured to be connected to corresponding HV towers in a manner described below.

Secondary winding 36, as described above, is wound on spool 34, and includes first and second ends or leads. Each end is connected to a respective one of high-voltage terminals 48, and 50. As known, an interruption of a primary current $I_p$ through primary winding 30, as controlled by ignition system 12, is operative to produce a high-voltage at these ends of secondary winding 36. According to the invention, secondary winding 36 is wound in accordance with a progressive winding approach, which is known generally, for example, as seen by reference to U.S. Pat. No. 5,929,736 entitled "ENGINE IGNITING COIL DEVICE AND METHOD OF WINDING AN IGNITION COIL" issued to Sakamaki et al., hereby incorporated by reference for this purpose. In particular, the progressive wound secondary winding 36 is formed having a predetermined number of layers wherein each layer of secondary winding 36 is disposed at preselected angles taken in an axial direction, on the smooth outer surface of spool body 46. In one embodiment, secondary winding 36 comprises 15,272 turns (plus or minus 20 turns) of #41 AWG, heavy build wire, with a resistance associated therewith between about 4200–5200 ohms at 25° C. (plus or minus 10° C.), and with a nominal secondary winding height of 1.64 millimeters.

Referring to FIG. 5, module assembly 20 is configured to provide an interface between the coil assemblies $\mathbf{18}_i$ and ignition system 12. Module assembly 20 is further configured to include power switching circuitry operative to carry primary energization current in response to electronic spark timing command signals from ignition system 12. This function is well understood in the art, and will therefore not be described in any further detail. Module assembly 20 includes a low-voltage (LV) connector body 52, a lead frame having a first plurality of electrically conductive terminals 54 and a second plurality of electrically conductive terminals 56, gel fill material 58, a module cover 60, an alignment feature 62, a substrate 63, and a backplate 64.

Connector body 52 comprises, generally, electrical insulating material having properties suitable for use in a relatively high temperature environment. For example, connector body 52 may comprise plastic material such as polybutylene terephthalate (PBT) thermoplastic polyester, commercially available under the tradename RYNITE® specification RE5220 BK533, from E. I. du Pont de Nemours and Company, Wilmington, Del., USA. It should be understood that there are a variety of alternative materials, which may be used for connector body 52 known to those of ordinary skill in the art, the foregoing being exemplary only and not limiting in nature.

Terminals 54 provide a male-type connector half, which, in cooperation with an industry standard, corresponding female connector, forms an electrical connection that carries signals from ignition system 12. In the illustrated embodiment, there are six terminals 54 corresponding to the following signals: ground (GND), electronic spark timing low (EST LO), electronic spark timing for cylinders 1 and 4 (EST 1/4), electronic spark timing signal for cylinders 2 and 5 (EST 2/5), electronic spark timing cylinders for 3 and 6 (EST 3/6), and battery voltage (B+). As is generally known, assertion of one of the electronic spark timing signals commences a "dwell" interval, which ends when such signal is discontinued. Primary current $I_p$ builds up during the dwell interval. Interrupting the primary current causes a high voltage to be produced by the coil that results in the spark plug in the corresponding cylinder firing.

Terminals 56, in the illustrated embodiment, comprise six (6) in number, two terminals for each one of the coil assemblies $\mathbf{18}_i$. In particular, for each coil assembly $\mathbf{18}_i$, there is provided a "B+" terminal and a "C−" terminal. The B+ terminal is for connecting a high side end of a respective primary winding 30 to a battery voltage. The "C−" terminal is for connecting a second, low side end of a respective primary winding 30 to the above-described power switching circuitry for selective connection to ground according to one of the electronic spark timing (EST) signals. Through the foregoing, module assembly 20 can selectively dispose a respective one of the primary windings 30 between battery voltage and ground to thereby establish a primary current $I_p$ therethrough.

Gel material 58 comprises material suitable for use in encapsulating solid state electronic devices, and power connections associated therewith.

Module cover 60 is formed generally of electrical insulating material, and, for example, may comprise the PBT material referred to above, commercially available under the tradename RYNITE® RE5220 BK533, from E. I. du Pont de Nemours and Company, Wilmington, Del., USA. Of course, other materials known to those of ordinary skill in the art may be substituted and remain within the spirit and scope of the present invention.

Alignment feature 62 comprises a laterally extending channel configured in size and shape to receive a corresponding alignment feature 94 formed in case 22. In the preferred embodiment, alignment feature 94 is side wall 72.

Substrate 63 comprises electrically insulating material, and may be, for example, 96 percent aluminum oxide ceramic. Substrate 63 may include the conventional power switching circuitry referred to above.

Backplate 64 seals the interior of low-voltage (LV) connector body 52, and may comprise aluminum material. Substrate 63 may be secured to backplate 64 through use of a suitable adhesive, and through backplate 64, heat may be safely dissipated. Wires (not shown) may be bonded between substrate 63 and the lead frame (shown partially as terminals 54, and 56) to establish electrical connections between power switching circuitry, and terminals 54 and terminals 56, as described above.

FIG. 1 show that case assembly 22 forms an enclosure for receiving various sub-assemblies. Case assembly 22 includes a base wall 66 comprising an inner surface 68 and an outer surface 70 (best shown in FIG. 5), a plurality of side walls 72 defining an interior space 74. Case assembly 22 is open on one end through a top opening 76 (best shown in FIG. 5). Case assembly 22 further includes a plurality of towers 78, one for each cylinder. In the Figures, tower $\mathbf{78}_1$, corresponds to cylinder No. 1 of the engine, tower $\mathbf{78}_2$ corresponds to cylinder No. 2 of the engine, and so on through tower $\mathbf{78}_6$ for cylinder No. 6 of the engine. Case assembly 22 further includes a plurality of separator walls $\mathbf{80}_1$, and $\mathbf{80}_2$ extending generally in a direction perpendicular to base wall 66. Separator walls $\mathbf{80}_1$, and $\mathbf{80}_2$ define a plurality of cavities $\mathbf{82}_1$, $\mathbf{82}_2$, and $\mathbf{82}_3$ configured to receive a corresponding coil assembly $\mathbf{18}_i$ (best shown in FIG. 2). Case assembly 22 further includes a plurality of alignment rails 84 to facilitate and align coil assemblies upon final assembly.

Figure 2:
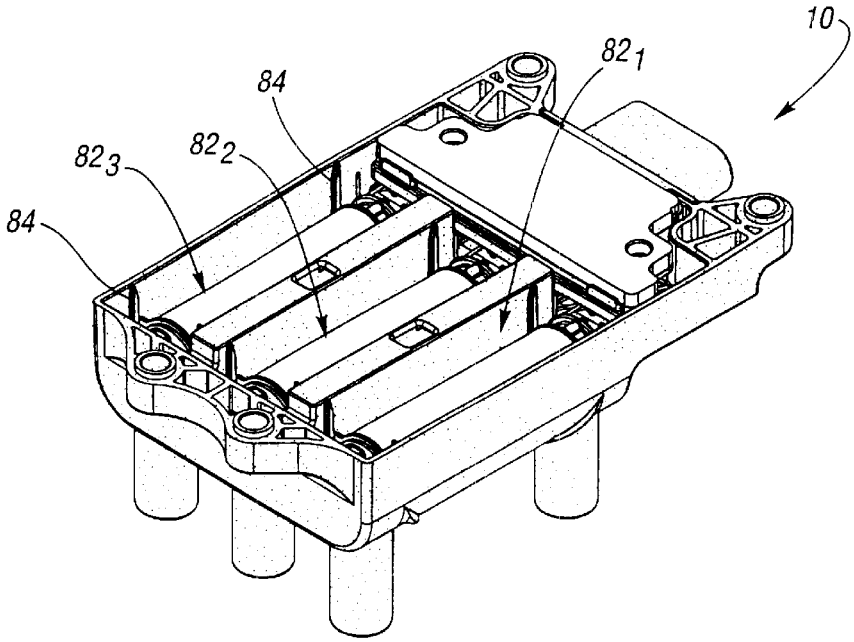
FIG. 2 is a perspective view of the ignition coil assembly of FIG. 1 in a partially assembled state.

Referring to FIGS. 2 and 4, each cavity $\mathbf{82}_1$, $\mathbf{82}_2$, and $\mathbf{82}_3$ is defined in part by a first portion of base wall 66 (particularly the inner surface 68 thereof), and is characterized by a predetermined shape. As best shown in FIG. 4, the shape is substantially U-shaped in cross-section, and may be cylindrical in shape when viewed along its longitudinal extent.

As shown in FIG. 5, case assembly 22 may further include a bushing 86, a plurality of high-voltage connector terminals 88 each having associated therewith a corresponding spring contact assembly 90, a spacing feature 92, and an alignment feature 94. Towers 78 surround HV connector terminals 88. Towers 78 and connector terminals 88 are adapted in size and shape to receive a conventional "boot" portion of ignition cable 15 (not shown).

Case assembly 22 may be formed of electrical insulating material, and may be, for example, the PBT material referred to above, commercially available under the tradename RYNITE® from E. I. du Pont de Nemours and Company, Wilmington, Del., USA.

FIG. 1 shows shield 24 in perspective view. Shield 24 includes a plurality of tangs 96 for securing shield 24 to an outer surface of case assembly 22. Shield 24 may be formed of magnetically-permeable material, such as 1008 steel. However, other suitable materials may be used and remain within the spirit and scope of the invention.

Figure 3:
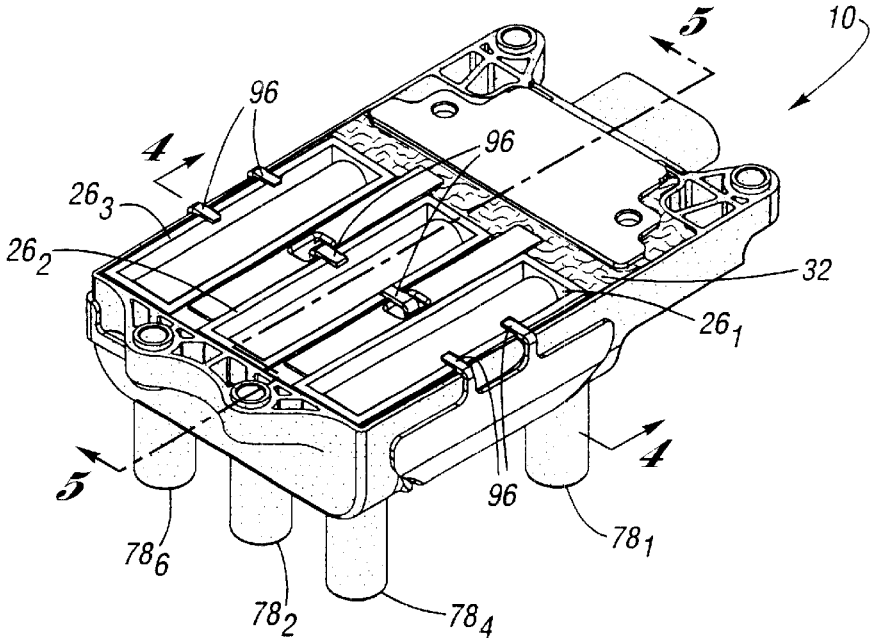
FIG. 3 is a simplified, perspective view of the ignition coil assembly of FIG. 1 in a fully assembled, and potted state.

Referring to FIGS. 3 and 4, coil covers $\mathbf{26}_1$, $\mathbf{26}_2$, and $\mathbf{26}_3$ may be formed from the same material as case assembly 22, particularly electrical insulating material. For example, this material may be PBT material referred to elsewhere. Covers $\mathbf{26}_1$, $\mathbf{26}_2$, and $\mathbf{26}_3$ are configured to conform to the shape of coil assemblies $\mathbf{18}_i$, and fit in respective cavities $\mathbf{81}_1$, $\mathbf{82}_2$, and $\mathbf{82}_3$ to seal a respective upper opening thereof.

With initial reference to FIG. 1, a description of the assembly of ignition coil assembly 10 will now be set forth. First, coil assemblies 18 may be manufactured and pre-tested. For example, primary winding 30 may be wound on a primary winding spool and assembled over an already formed core 28 therewith. Next, secondary winding 36 may be wound in a progressive fashion in accordance with the present invention on secondary winding spool 34. The first and second ends of secondary winding 36 are connected to high-voltage terminals 48 and 50, which are then bent into an "L" shape (see FIG. 5) having a short-leg that is parallel to axis A (i.e., the long axis of coil assembly 18). Next, the core 28/primary winding 30 assembly may be inserted into an inside diameter portion of secondary winding spool until mechanical stop 42 abuts shoulder 44. This feature provides positive feedback to the assembly operator as to the desired, completed orientation. This "stop" feature is best shown in FIG. 6, in a completely assembled state. First and second leads (e.g., end 98) of primary winding 30 are temporarily wound on respective posts 38. This completes the assembly for one of coil assemblies $\mathbf{18}_i$. This process is repeated for any further coil assemblies 18 included in ignition coil assembly 10. Of course, at various points during this process, both primary coil 30, and secondary coil 36 may be tested for "opens", "shorts", and other desired electrical characteristics (e.g., resistance end-to-end).

Next, module assembly 20 is assembled. This phase may involve an insert molding operation of a lead frame comprising terminals 54, and 56 into LV connector body 52. Substrate 63 is adhered to backplate 64 (e.g., using adhesive), wires are connected, as appropriate, from substrate 63 to the lead frame, and the substrate 63/backplate 64 combination is secured to the connector body 52. The interior cavity of connector body 52 is then filled with gel 58, and module cover 60 is secured to the connector body (e.g., using adhesive). This completes the assembly of module assembly 20. Certain electrical tests may then be performed to ensure that the desired manufacture of this subassembly has been achieved.

Next, coil assemblies 18 are electrically connected to module assembly 20. This involves the step of connecting the leads of the respective primary windings 30 (i.e., the ends 98) to corresponding terminals 56 of module assembly 20 (as shown in FIG. 1, and FIG. 5). The resulting subassembly, namely, the coil and module assembly 16, which corresponds to the upper most view of FIG. 1, may be completely tested to ensure desired operation.

Referring now to FIG. 2, next, coil and module assembly 16 is inserted through opening 76 of case assembly 22 until a top surface of case assembly 22 is substantially flush with the top of module assembly 20 (i.e., particularly, the top of backplate 64). In this regard, flanges near the ends of coil assemblies 18 cooperate with alignment rails 84 to ensure proper placement of the coil assemblies in the corresponding cavities $\mathbf{82}_1$, $\mathbf{82}_2$, and $\mathbf{82}_3$. HV terminals 48 and 50 of coil assemblies $\mathbf{18}_i$ are disposed on an underside thereof, as inserted into case 22. The spring contacts 90 are located in the cavities so as to be in registration with the HV terminals upon insertion. The HV terminals 48 and 50 therefore engage respective spring contacts 90 disposed at the bottom of each cavity $\mathbf{82}_1$, $\mathbf{82}_2$, and $\mathbf{82}_3$. This contact establishes an electrical connection between each end of secondary winding 36 and a respective HV connector terminal 88. An ignition cable 15 then may be connected from each HV connector terminals 88 to a corresponding spark plug 14 when ignition coil assembly 10 is deployed in a vehicle.

Next, coil covers $\mathbf{26}_1$, $\mathbf{26}_2$, and $\mathbf{26}_3$ are disposed on top of coil assemblies $\mathbf{18}_{1\text{-}4}$, $\mathbf{18}_{2\text{-}5}$, and $\mathbf{18}_{3\text{-}6}$, respectively.

Next, shield 24 is applied to outer surface 70 of case assembly 22 such that the central two tangs 96 of shield 24 extend through separator walls 80. These and the other tangs are then bent over to secure the shield to case assembly 22. This is shown in FIG. 3. An alignment feature is formed on the outer surface 70 of case 22 to ensure that the shield 24 is positioned correctly.

With reference to FIG. 3, finally, epoxy potting material 32 is delivered into the interior 74 of case assembly 22 so as to flow into and fill voids to thereby encapsulate various portions of ignition coil assembly 10, in a manner known to those of ordinary skill in the art. The completed ignition coil assembly 10 is shown in FIG. 3.

Referring to FIG. 5, advantageous use of a progressive wound secondary winding 36 allows use of a secondary winding spool 34 that does not include a plurality of axially-spaced ribs defining winding slots. In particular, use of a progressive winding approach for the secondary winding 36 allows placement of the core 28 close enough to shield 24 so as to not require use of pole pieces to complete the magnetic circuit. This results in an ignition coil assembly that has fewer components, is lighter, costs less, and is smaller than conventional separate-mount ignition coil assemblies that use segment wound secondaries. Moreover, use of a progressive wound secondary winding eliminates the failure modes associated with segment wound secondary windings, as described in the background of the invention.

It is to be understood that the above description is merely exemplary rather than limiting in nature, the invention being limited only by the appended claims. Various modifications and changes may be made thereto by one of ordinary skill in the art, which embodies the principles of the invention and fall within the spirit and scope thereof.

I claim:

1. An ignition coil comprising:

a coil assembly having a core formed of magnetically-permeable material extending along a main axis, a primary winding disposed about the core, a secondary winding disposed on a secondary winding spool disposed about the core wherein each of first and second ends of the secondary winding is electrically connected to a respective high-voltage terminal, the secondary winding being progressively wound on the secondary winding spool;

a case formed of electrical insulating material; and a magnetically-permeable shield disposed outwardly of the case wherein the case includes a base wall having an inner surface proximate an interior of the case and an outer surface, the case further including a plurality of side walls extending from the base wall to thereby form an access opening to the interior of said case, wherein the case further includes high-voltage (HV) connector terminals corresponding to said high voltage terminals configured for connection to remotely disposed spark plugs, said HV connector terminals being surrounded by a respective tower having an opening for providing access thereto, the tower being formed of electrical insulating material, further comprising contacts associated with said HV connector terminals, said contacts being located in said interior of said case so as to be in registration with said HV terminals of said coil assembly upon insertion of said coil assembly in the interior of said case.

2. The ignition coil of claim 1 wherein the tower extends from the outer surface of the base wall of the case.

3. The ignition coil of claim 1 wherein said case further includes alignment rails to ensure a desired placement of said coil assembly.

* * * * *